US005489377A

United States Patent [19]

Kramer et al.

[11] Patent Number: 5,489,377

[45] **Date of Patent: *Feb. 6, 1996**

[54] RECOVERY OF HARD ACIDS AND SOFT BASES FROM DECOMPOSED COAL

[75] Inventors: George M. Kramer, Berkeley Heights; Andres M. Fraga, East Brunswick, both of N.J.

[73] Assignee: Exxon Research and Engineering Company, Florham Park, N.J.

[ * ] Notice: The term of this patent shall not extend beyond the expiration date of Pat. No. 5,298,157.

[21] Appl. No.: 289,723

[22] Filed: Aug. 12, 1994

[51] Int. Cl.[6] ..... C10G 1/00

[52] U.S. Cl. ..... 200/400; 208/422; 208/424; 208/428; 208/435

[58] Field of Search ..... 208/400

[56] References Cited

U.S. PATENT DOCUMENTS

| | | | |
|---|---|---|---|
| 1,881,927 | 10/1932 | Pott et al. . | |
| 2,202,901 | 6/1940 | Dreyfuss | 196/33 |
| 2,347,231 | 4/1944 | Stonewener | 196/52 |
| 3,282,826 | 11/1966 | Winkler | 208/8 |
| 3,502,564 | 3/1970 | Hodgson | 208/9 |
| 3,505,203 | 4/1970 | Nelson | 208/8 |
| 3,532,617 | 10/1970 | Hodgson | 208/10 |
| 3,549,512 | 7/1970 | Hodgson | 208/10 |
| 3,677,932 | 7/1972 | Hardesty et al. | 208/108 |
| 3,748,254 | 7/1973 | Gorin | 208/8 |
| 3,755,137 | 8/1973 | Schuman | 208/10 |
| 3,764,515 | 10/1973 | Kiovsky | 208/10 |
| 3,840,456 | 10/1973 | Yavorsky et al. | 208/10 |
| 3,841,991 | 4/1973 | Cohen et al. | 208/8 |
| 3,893,943 | 7/1975 | Willard, Sr. | 208/8 |
| 3,988,238 | 10/1976 | McCollum et al. | 208/8 |
| 4,056,460 | 11/1977 | Malek | 208/8 |
| 4,090,944 | 5/1978 | Moore et al. | 208/10 |
| 4,176,051 | 11/1979 | Ternan et al. | 208/112 |
| 4,333,815 | 6/1982 | Vermeulen et al. | 208/10 |
| 4,376,695 | 3/1983 | Belinko et al. | 208/59 |
| 4,394,247 | 7/1983 | Olah | 208/10 |
| 4,426,313 | 1/1984 | Swedo | 208/10 |
| 4,518,478 | 5/1985 | Weller | 208/8 LE |
| 4,534,848 | 8/1985 | Sanada et al. | 208/10 |
| 4,539,095 | 9/1985 | Sunder et al. | 208/10 |
| 4,617,105 | 10/1986 | Miller | 208/412 |
| 4,626,342 | 12/1986 | Garg et al. | 208/419 |
| 4,675,120 | 6/1987 | Martucci | 208/46 |
| 4,728,418 | 3/1988 | Shabitai et al. | 208/413 |
| 5,026,475 | 6/1991 | Stuntz et al. | 208/403 |
| 5,064,527 | 11/1991 | Singhal et al. | 208/420 |
| 5,288,859 | 2/1994 | Sabesan | 536/124 |
| 5,294,349 | 3/1994 | Krmaer et al. | 208/400 |
| 5,296,133 | 3/1994 | Kramer et al. | 208/400 |
| 5,298,157 | 3/1994 | Kramer et al. | 208/400 |

OTHER PUBLICATIONS

K. Fuji, T. Kawabata, E. Fujita, ChemPharm. Bull. (Japan), vol. 28, pp. 3662–3664 (1980).

Chemistry of Coal Utilization, 2nd Supp. vol., Ed. by M. Elliott, Chpt. 8, pp. 425–454 (1981), Wiley Interscience.

M. Node, H. Hori, E. Fujita, J. Chem. Soc. Perkin I, 1976, pp. 2237–2240.

F. Derbyshire, Chemtech, 1990, Jul., pp. 439–443.

C. Lapierre, B. Pollet, B. Monties, Holzforschung, vol. 45, pp. 61–68 (1991).

Handbook for Pulp and Paper Technologists, G. A. Smook, author, p. 6, TAPPI, Atlanta, Ga. (1988).

*Primary Examiner*—Helane Myers

*Attorney, Agent, or Firm*—Estelle C. Bakun

[57] ABSTRACT

An improved process for recovering hard acids and soft bases used to decompose coal in which finely divided coal particles are contacted with a hard acid in the presence of a soft base at temperatures of from 0° to 100° C., said hard acid being characterized by a heat of reaction with dimethylsulfide of from 10 kcal/mol to 30 kcal/mol and said soft base being characterized by a heat of reaction with boron trifluoride of from 10 kcal/mol to 17 kcal/mol, followed by extracting the decomposed coal to remove said hard acid and soft base wherein the improvement comprises performing said extraction at a temperature of about 0° to about 50° C. using dimethylcarbonate as the extraction solvent, and wherein following said dimethylcarbonate extraction, said coal is extracted with water at a temperature of from about 60° to 275° C., and wherein following said water extraction, said coal is soxhlet extracted in sulfolane at a temperature of about 25° to about 350° C., and wherein following said sulfolane extraction, said coal is soxhlet extracted to remove said sulfolane.

7 Claims, No Drawings

RECOVERY OF HARD ACIDS AND SOFT BASES FROM DECOMPOSED COAL

FIELD OF THE INVENTION

The instant method is directed toward a method for recovering hard acids and soft bases after use in the hard acid soft base (HSAB) decomposition of Rawhide coal. The instant method advantageously leaves nearly all of the inorganic elements and the organic fragments in the residue after extraction of the acid. The decomposed coal is an excellent feedstock for liquefaction and can be converted in high yields to light liquid products under mild hydroprocessing conditions. The decomposed coal can also be converted to low ash coal.

BACKGROUND OF THE INVENTION

Studies on the structure of coal have established that coal has a complex network structure containing ethers and short alkyl or alkylene chains as typical linking groups between substituted aromatic units typically with ring numbers of 1 to 4.

There are numerous processes for the conversion of coal to liquid hydrocarbon products involving hydroprocessing coal in the presence of a catalyst system. These processes typically utilize nickel, tin, molybdenum, cobalt, iron and vanadium containing catalysts alone or in combination with other metals such as selenium at high temperature, alone or in combination, with high hydrogen pressure. Coal can be impregnated with catalyst or the catalyst supported on a carrier. In some processes, coal is subjected to an initial solvent extraction prior to hydroprocessing. Solvents used for extraction include tetralin, decalin, alkyl substituted polycyclic aromatics, phenols and amines. Typical solvents are strong hydrogen donors.

Coal liquefaction may also be accomplished using combinations of catalysts with various solvents. Metal halides promoted with a mineral acid, $ZnCl_2$ in the presence of polar solvents and quinones in combination with ammonium ions, group 1*a* or 1*b* metal alkoxides or hydroxides or salts of weak acids have been used as catalyst systems for coal liquefaction. Aqueous solutions containing catalysts such as alkali metal silicates, calcium or magnesium ions and surfactants form media for breaking down coal.

Coal can be depolymerized into lower molecular weight fractions by breaking the ether, alkyl or alkylene bridging groups which collectively make up coal's polymeric structure. Catalysts for coal depolymerization include $BF_3$ complexed with phenol, Bronsted acids such as $H_2SO_4$, p-toluenesulfonic, trifluoromethanesulfonic and methanesulfonic acid in the presence of a phenolic solvent, $ZnCl_2$ or $FeCl_3$. This is followed by hydrotreatment. Depolymerization reactions have been reviewed by Wender et al, "Chemistry of Coal Utilization," 2nd Supplementary Volume, M. A. Elliot ed, J. Wiley & Sons, NY, 1981, pp. 425 et seq.

The high temperatures required by catalyzed coal liquefaction processes lead to refractory materials and liquefied hydrocarbon oils containing significant amounts of vacuum gas oil and other higher boiling components.

It is known in the art to use a hard acid soft base system (HSAB) to decompose coal. See for example, U.S. Pat. Nos. 5,298,157; 5,296,133 and 5,294,349. In such systems, coal is rapidly decomposed at low temperatures while minimizing the formation of refractory material by controlling side reactions leading to such materials. The finely divided coal particles are contacted with a hard acid in the presence of a soft base at temperatures of from 0° C. to 100° C., said hard acid being characterized by a heat of reaction with dimethylsulfide of from 10 KCal/mol to 30 KCal/mol and said soft base being characterized by a heat of reaction with boron trifluoride of from 10 KCal/mol to 17 KCal/mol. The decomposed coal can then be converted to low ash coal by extracting it to remove the hard acid and soft base. However, the extraction systems employed by the prior art have the questionable characteristic of removing many of the inorganic elements along with cleaved coal fragments resulting in sizable amounts of ash forming material as well as organic components being prematurely distributed to two locations, the extract and the residue.

SUMMARY OF THE INVENTION

Applicants have developed a method for producing low ash coal extracts and residues by first extracting the hard acid and soft base from the decomposed coal while advantageously maintaining more than 90% of the inorganic elements and decomposition fragments in the residue and later extracting the inorganic components.

Hence, applicants have developed a method for extracting the bulk of the hard acid and soft base from the coal in a manner leading to their facile recovery while advantageously keeping nearly all of the inorganic elements and coal's decomposition fragments in the residue.

Hence, the present invention is directed toward a method for recovering hard acids and soft bases used to decompose coal, said process comprising of contacting finely divided coal particles with a hard acid in the presence of a soft base at temperatures of from 0° to 100° C., said hard acid being characterized by a heat of reaction with dimethylsulfide of from 10 kcal/mol to 30 kcal/mol and said soft base being characterized by a heat of reaction with boron trifluoride of from 10 kcal/mol to 17 kcal/mol, extracting the decomposed coal to remove said hard acid and soft base and wherein the improvement comprises performing said extraction at a temperature of about 0° to about 50° C. using dimethylcarbonate as the extracting solvent and wherein said dimethylcarbonate extracted coal is extracted with water at a temperature of about 60° to 275° C. followed by soxhlet extraction in sulfolane. Such water treatment removes any acid left in the decomposed coal after the dimethylcarbonate (DMC) treatment and displaces chemically bound dimethylsulfide as well.

The dimethylcarbonate extraction is believed to remove all physically adsorbed acid and dimethylsulfide leaving some of the acid in the coal in the form of esters [coal mesylate compounds], as a component of "coal-dimethylsulfonium - mesylate salts, and as a component of inorganic mesylate salts such as $Ca(CH_3SO_3)_2$. The hot water wash has been found to eliminate >95% of all the sulfur containing products added to the coal in these forms leading to an excellent recovery of e.g. methanesulfonic acid (MSA) and dimethylsulfide ($Me_2S$), the hard acid and soft base components.

The hot water treat will not recover MSA from its inorganic salts. However, the acid can be reclaimed from aqueous solutions if desired by a variety of procedures known in the art. Some of these include the addition of $H_2S$ to precipitate inorganic sulfides and reform MSA. The water may then be removed by distillation or by entrainment in a flowing gas stream [air or $N_2$] distilled leaving MSA as a high boiling solvent. It may also be recovered by the addition of an acid stronger than MSA, i.e. like $H_2SO_4$ or HCl in combination with an organic extractant.

When the water extracted decomposed coal while still damp (dried by vacuum distillation and heating to an upper limit of 60° C., preferably 25° C.) is soxhlet extracted with sulfolane, this solvent recovers relatively small decomposition fragments from the residue. Applicants believe such fragments contain a variety of one, two and three ring aromatic compounds.

Soxhlet extraction with sulfolane can be done at any temperature up to the boiling point of sulfolane (285° C.). To minimize the possible occurrence of side reactions and to facilitate the process. these extractions may be conducted at lower temperatures and pressure. For example, at temperatures of about 200° C. at an absolute pressure of −680 mm of Hg or 89 kPA. At such a temperature, very little cracking occurs. Temperatures as low as 25° C. and as high as 285° C. can be used.

The sulfolane extract will pass through an 0.5μ filter and is believed to be composed of molecules smaller than 50 Å on the basis of light scattering and size exclusion chromatographic studies. It is important that the damp coal not be dried at too high a temperature before the sulfolane extraction as vacuum drying near 80° C. has been found to noticeably lower the extractability of the coal. This is attributed to condensation or cross linking reactions which may occur under these conditions, often with the elimination of water.

The extracted decomposition products, which impart color to the sulfolane solution, may be recovered by several procedures. One is by adding water to induce the formation of aggregates which precipitate. Light scattering studies show that adding water leads to a rapid growth in particle size. At water to sulfolane wt ratios in the range of 2/1 to 10/1 and preferably from 2/1 to 5/1 the aggregates grow to ca. 70,000 to 80,000 Å at which point they begin to precipitate. The precipitate is dark brown or black and as it settles, all the color is removed from the solution. Water may be distilled from the aqueous sulfolane solution leaving the solvent suitable for recycle.

The precipitate which separates from the water/sulfolane solution appears to be solvated strongly by sulfolane. This sulfolane can be removed by washing the precipitate with an organic solvent which mixes well with sulfolane but not with the coal extracts. As an example, chlorobenzene has been found to be efficient at removing sulfolane from the extracted precipitate. Since chlorobenzene boils much below sulfolane, it can easily be removed by distillation leaving sulfolane for reuse. Other solvents like toluene or xylenes are expected to behave similarly to chlorobenzene.

Following any of the embodiments of the instant invention, the extracts and/or the residual extracted decomposed coal can be hydroprocessed to produce light hydrocarbon oils by forming a mixture of treated coal and catalyst precursor containing a dihydrocarbyl-substituted dithiocarbonate of a metal selected from any one of groups IV-B, V-A, VI-A, VII-A and VIII-A (as given in the periodic table set forth in F. A. Cotton and G. W. Wilkinson, "Advanced Inorganic Chemistry," 4th ed., John Wiley and Sons, NY) or mixtures thereof, hydroprocessing the mixture at temperatures of from 250° C. to 550° C. and a hydrogen partial pressure of from 2100 kPa to 35000 kPa and recovering hydrocarbon oil.

DETAILED DESCRIPTION

In accordance with the present invention, coal is decomposed by contacting finely divided coal particles with a hard acid in the presence of a soft base at temperatures of from 0° C. to 100° C., said hard acid being characterized by a heat of reaction with dimethylsulfide of from 10 kcal/mol to 30 kcal/mol and said soft base being characterized by a heat of reaction with boron trifluoride of from 10 kcal/mol to 17 kcal/mol and extracting the decomposed coal to remove hard acid and soft base. The decomposed coal may be converted to a low ash coal by extracting it to remove the hard acid and soft base and a portion of the mineral contaminants followed by treating the extracted coal with a swelling solvent to remove mineral contaminants not removed by extraction. Extracted decomposed coal can be hydroprocessed to produce light hydrocarbon oils by forming a mixture of decomposed coal and catalyst precursor containing a dihydrocarbyl substituted dithiocarbamate of a metal selected from any one of groups IV-8, V-A, VI-A, VII-A and VIII-A (as given in the periodic table set forth in F. A. Cotton and G. W. Wilkinson, "Advanced Inorganic Chemistry," 4th ed., John Wiley and Sons, NY) or mixtures thereof, hydroprocessing the mixture at temperatures of from 250° C. to 550° C. and a hydrogen partial pressure of from 2100 kPa to 35000 kPa and recovering hydrocarbon oil.

The combined hard acid and soft base treatment rapidly cleaves and traps the components of many ether and alkyl-aromatic linkages in the coal structure which are normally susceptible to acid catalysts while controlling or minimizing retrograde reactions which could lead to more refractory materials. Decomposition occurs rapidly at temperatures below 100° C. without added pressure. At room temperature, maximum depolymerization typically is accomplished in less than one hour. The resulting decomposed coal can then be solvent extracted to remove the reagents, some cleaved fragments and a variable amount of the mineral matter while leaving the bulk of the decomposed coal as a residue. With a suitable solvent this residue can be left with a very low mineral content. Hydroprocessing the decomposed coal under mild conditions, with or without extraction, results in liquefied hydrocarbons being produced at higher rates and at higher conversion levels to more desirable light liquid hydrocarbons than are attainable from the untreated coal.

Hard acids are of small size, have high positive charge, have empty orbitals in their valence shells and are characterized by low polarizability and high electronegativity. Soft bases are electron donors and are characterized by having high polarizability, low electronegativity and are easily oxidized. In general, hard acids prefer to bond to hard bases and soft acids prefer to bond to soft bases.

These general characteristics have been discussed in a series of articles written by R. G. Pearson, many of which are summarized in, "Hard and Soft Acids and Bases," Ed. R. G. Pearson, Dowden, Hutchinson & Ross, Inc. 1973. Hard acids are typified by H+, $Al^{3+}$, $B^{3+}$, and $U^{6+}$ where these ions may be isolated species or components of molecules or larger ions containing vacant orbitals like $AlBr_3$, $BF_3$ or $UO_2^{2+}$ etc. Typical soft bases are molecules containing S or P atoms as in EtSH or $Me_2S$ or $Me_3P$ rather than O or N atoms as in the corresponding compounds EtOH, $Me_2O$ and $Me_3N$. The latter 3 compounds are typical strong bases and are expected to form strong coordination complexes with hard acids. The strong interaction essentially neutralizes the acids. Hard acids according to the present invention are characterized by a heat of reaction (or complexation) with dimethylsulfide in the range of from 10 kcal/mol to 30 kcal/mol. Similarly, soft bases are characterized by a heat of reaction (or complexation) with boron trifluoride in the range of from 10 kcal/mol to 17 kcal/mol. As noted by W. B. Jensen, "The Lewis Acid-Base Concepts," J. Wiley &

Sons, 1980, p. 253, the hard soft acid base ("HSAB") concept is qualitative in nature. As discussed in Jensen's book, heats of reaction (or complexation) provide one method of delineating hard soft acids bases. Preferred hard acids are methanesulfonic acid, toluenesulfonic acid, benzenesulfonic acid, trifluoromethanesulfonic acid, and preferred soft bases are ethylmercaptan, methylmercaptan, diethylsulfide, methylphenylsulfide and dimethylsulfide.

By contrast, in mixtures of hard acids and soft bases the components are relatively free and hence able to act relatively independently. Thus hard acidic reagents like protons can attack many ethers and initiate bond cleavage reactions leading to carbocation formation while a sulfur compound like EtSH or $Me_2S$ (both of which are known to be very good nucleophiles) will react with these ions more rapidly than an oxygenated base like water. Trapping a carbocation by EtSH forms a protonated sulfide or sulfonium ion which upon loss of a proton leaves a sulfide as a final product. Trapping with $Me_2S$ on the other hand forms a more stable tertiary sulfonium ion which will tend to remain in the final product as a salt.

Both mercaptans and sulfides like $Me_2S$ are efficient trapping agents. To a large extent, the sulfonium ions produced by $Me_2S$ function as reaction intermediates and the bulk of the reagent is easily regenerated. Using $Me_2S$ as a trapping agent does not seem to produce a large amount of relatively stable sulfonium salts. To a significant degree these can be decomposed by treatment with a solvent like MeOH. Most of the $Me_2S$ can be recovered, however, some of the salts appear to convert to unidentified sulfur compounds through unknown side reactions thereby rendering some $Me_2S$ difficult to recover. Typically, this loss is less than 5%.

The catalyst system of the invention may be applied to the decomposition of coal and other similar naturally occurring hydrocarbons. Rawhide and Wyodak coals are subbituminous coals with an overall composition containing about 20 or more percent organically bound oxygen, and other subbituminous coals of similar overall composition should behave in a similar manner. Since higher rank coals which contain relatively more alkylaromatic bonds than ether linkages are amenable to acid catalyzed cleavage reactions, it is believed that similar benefits will be found throughout the range of available coals. While particle size is not critical to the invention, it is preferred to use finely divided coal to increase surface area and therefore efficiency of reaction. Preferred coal particle sizes are from 10 to 1000μ, especially 10 to 250μ.

No added solvent is required as the hard acid/soft base catalyst system itself can function as the solvent. If desired, an added solvent or co-solvent can be employed. The major role of the solvent in the HSAB system is to facilitate the access of the acidic and basic reagents to sites within the coal structure so that the nucleophile is present when the instant cleavage occurs. It is known that coals swell as they absorb solvents which interfere with hydrogen bonding interactions endemic to the material. Thus a solvent which interacts with a phenolic proton which would otherwise be bonding to another site in the matrix would be expected to swell the coal and aid the desired access of the HSAB components, provided that the added solvent itself is not so basic as to neutralize the acidic catalyst.

Alternatively one may add a nonreactive, nonswelling but freely flowing co-solvent like n-hexane to EtSH or $Me_2S$ to facilitate formation of slurry. Such a co-solvent has been used to facilitate separation and detection by gas chromatography of decomposition fragments resulting from the HSAB reaction of the coal. In the reaction of Wyodak coal with $BF_3{:}H_2O$ in 50:50 EtSH:$nC_6H_{14}$ the hexane layer has been found to contain 2,2-dithioethylpropane, $CH_3$-$C(C_2H_5S)_2$-$CH_3$, as a major product of the coal cleavage reaction. Co-solvents like hexane may also be used to wash unreacted mercaptans and sulfides from the depolymerized coal even though they have little tendency to swell the coal.

Unlike other catalyst systems for decomposing coal, the hard acid/soft base catalyst of the invention decomposes coal rapidly under very mild conditions. Pressures are autogenous and temperatures range from 0° to 100° C. The preferred temperature range is 15° to 75° C. Even at room temperature, decomposition typically is complete in less than one hour.

The processes of the instant invention thus provide a rapid and useful method for recovering hard acids used to decompose Rawhide coal. The method is particularly attractive because it enables the hard acid to be removed without reducing the ash forming material in the coal. Thus, more than 90% of inorganic elements and coal's decomposition fragments remain in the residue while the bulk of the treating acid is removed following the current procedures.

The acid thus removed can be easily and inexpensively recovered for reuse. This follows because dimethylcarbonate is a low boiling solvent which can be removed from the extract solution by distillation leaving a concentrated solution of e.g. methanesulfonic acid for recycle in the process. Unlike the methanol system utilized by the prior art, dimethylcarbonate leaves the alkali and alkaline earth metals and heavier metals along with bitumen [the decomposed coal fragments] in the residue. Preferably the acids removed will be methanesulfonic acid and benzenesulfonic acid. More preferably, the acid will be methanesulfonic acid. The bases removed will be dimethylsulfide, diethylsulfide, di-n-alkylsulfides (n ranges from 1 to 10) and methylphenylsulfide, preferably dimethylsulfide and methylphenylsulfide.

The dimethylcarbonate (DMC) treatment can be carried out at temperatures of 0° C. to about 50° C., preferably 20° C. to about 40° C. Any extraction techniques known to those skilled in the art can be employed.

The DMC extraction of methanesulfonic acid leaves a decomposed coal residue containing a small amount of esterified methanesulfonic acid and some sulfonium salts which may be denoted as Coal-dimethylsulfonium$^+$ $CH_3SO_3$-compounds and inorganic salts of the acid.

Once the (DMC) extraction is complete more than 95% of the sulfur associated with these compounds can be eliminated from the residue by heating with water at temperatures from about 60° C. to about 275° C., preferably at least about 60° C. to about 110° C. The sulfur containing compounds removed from the residue are mainly dimethylsulfide and methanesulfonic acid and both of these may easily be recovered for reuse in the process.

Once the (DMC) extraction is complete, the decomposed coal is extracted with water at temperatures of at least about 60° to about 275° C., preferably at least about 60° to 110° C. The water extraction removes additional hard acid and a large fraction of the inorganic elements from the decomposed coal.

This aqueous solution may be distilled to provide water for use in further extracting additional amounts of DMC extracted coal. This is particularly useful in locations where the water supply is limited. The extract solutions may continually be combined to provide a concentrated solution of methanesulfonic acid containing a relatively high concentration of inorganic salts, i.e., inorganic mesylates. The metallic elements like $Ca^{2+}$ are removed by conventional means such as via the addition of $H_2S$ to precipitate their sulfides while the anions are reconverted to MSA.

Water is then removed by standard techniques like distillation, azeotropic distillation or with the aid of complexing reagents to further concentrate the MSA solution to ca. 98+% acid when it is suitable for reuse in the HSAB reaction. As one alternative to distillation we note that water can be stripped from MSA by passing a stream of dry air or $N_2$ through the aqueous solution.

As still another alternative MSA may be recovered from these conc. aqueous solutions by adding a stronger acid like $H_2SO_4$ or HCl in combination with an organic extraction solvent like ether or a hexane solution containing a surfactant [a long chain carboxylic or sulfonic acid or a polyether].

The water treated coal is then soxhlet extracted using sulfolane as the extracting solvent. This extraction is carried out at temperatures of at least about 25° to about 285° C., preferably 50° to about 250° C. Following sulfolane extraction, the coal is then washed. Washing can be carried out using water (60°–275° C.), or any solvent boiling below about 150° C. and which is miscible with sulfolane and immiscible with coal. For example, benzene, toluene, xylene, chlorobenzene, methanol and mixtures thereof, or mixtures thereof with water.

The following examples are for illustration and are not limiting.

EXAMPLE 1

An autoclave was charged with 50.12 g desiccator dried Rawhide coal, 50 ml of n-hexane, 50 ml of dimethylsulfide and 18.0 ml of methanesulfonic acid. The autoclave was heated and the contents allowed to react at 93°–94° C. The autoclave was then cooled to room temperature overnight (23°–24° C.). The mixture was continuously stirred throughout the run. The mixture formed a mass which was stirred extracted with 1400 ml of dimethylcarbonate (DMC). The coal was then filtered and washed 4 more times in DMC for a total of 5 washes. The coal was then soxhlet extracted at reflux for 2 days using 900 ml DMC and dried in a vacuum desssicator at 60° C. overnight. All DMC washes and the soxhlet extract were titrated with 1N NaOH.

1st wash stirred 90 minutes followed by filtering

2nd wash stirred 60 minutes followed by filtering

3rd wash stirred overnight followed by filtering

4th wash stirred 60 minutes followed by filtering

5th wash stirred 100 minutes followed by filtering

DMC soxhlet 900 gm overnight 32 hours.

Methanesulfonic Acid Recovery - Titrations with IN NaOH

| Item | Amount Acid Titrated Meg. | Amount Meg. % Recovery |
|---|---|---|
| 1st Wash | 83.63 | 30.38% |
| 2nd Wash | 41.10 | 45.31% |
| 3rd Wash | 51.83 | 64.14% |
| 4th Wash | 12.91 | 68.83% |
| 5th Wash | 6.25 | 71.10% |
| DMC Soxhlet | 33.90 | 83.42% |

EXAMPLE 2

The same amounts of Rawhide coal (50.10 g), dimethylsulfide (50.0 ml), n-hexane (50.0 ml) and methanesulfonic acid (18.0 ml) were reacted in an autoclave as in Example 1, however, the reaction temperature was 60°–65° C. The mixture was again cooled overnight and washed with a total of 800 ml of DMC for 60 minutes and filtered. It was rewashed 4 more times in 800 ml of DMC, for a total of 5 washes, then soxhlet extracted at reflux overnight with 900 ml of DMC. Dessicator drying overnight at 60° C. was performed and all washes and the soxhlet extract were titrated with 1N NaOH.

1st wash stirred 1 hour, then filtered

2nd wash stirred overnight, then filtered

3rd wash stirred 1 hour, then filtered

4th wash stirred 90 minutes, then filtered

5th wash stirred over weekend, then filtered

Methanesulfonic Acid Recovery

| Item | Amount of Acid Titrated (Meg) | Acid (Meg) % Recovered |
|---|---|---|
| 1st Wash | 93.63 | 35.30% |
| 2nd Wash | 39.40 | 50.15% |
| 3rd Wash | 21.77 | 58.36% |
| 4th Wash | 10.27 | 62.22% |
| 5th Wash | 9.09 | 65.77% |
| Soxhlet | 34.70 | 78.84% |

EXAMPLE 3

This example provides an estimate of the amount of sulfolane extracted coal which is obtained following a typical HSAB reaction and DMC extraction of MSA. This product is soxhlet extracted with water [which decomposes the sulfur compounds which had formed], then sulfolane and finally again with water.

A 5-liter round bottom glass flask containing a magnetic stirrer was charged with 200 g Rawhide coal, 200 ml DMS, 200 ml n-hexane and 76.5 ml MSA. The contents were stirred for 15 minutes and allowed to settle for 1 hour. The supernatant liquid was decanted and the residual coal was washed extensively with dimethylcarbonate. The coal was dried in a vacuum oven and then 30 g was soxhlet extracted with DMC and again dried in a vacuum oven at ca. 60°–80° C.

The HSAB product contained 8.3% S and formed 8.2% ash. Analyses of untreated Rawhide typically provide ranges of 0.5 to 0.6% S and 7.2 to 7.5% ash. This data is shown in columns 2 and 3 of Table 1. Column 4 shows the "S" and "Ash" in the product after it has been soxhlet extracted with water for 16 hours. This process drives off most of the acquired "S" and some of the "Ash." Column 5 shows these quantities left in the product after subsequent soxhlet extractions with sulfolane and again with water [to wash off adsorbed sulfolane]. The latter operation was incomplete as indicated by a rise in the "S" in the product.

Column 5 also shows the net estimated extent of sulfolane extraction of the HSAB product and of Rawhide. The latter estimate assumes that 50% of the added sulfur was due to acquired $Me_2S$ and the remainder from acquired MSA, proportions consistent with average values of the amount of acid left in the coal after the DMC extraction and the rise in "S" content of the coal.

TABLE 1

| 1 Analysis/ Sample | 2 Rawhide | Column 3 HSAB Product After DMC Sox. Extraction | 4 After $H_2O$ Sox. Ex-traction | 5 After Sulfolane and $H_2O$ Ex-traction |
|---|---|---|---|---|
| Sulfur, Wt % | 0.5 to 0.6 | 8.3 | 0.92 | 1.49 |
| Ash, Wt % | 7.2 to 7.5 | 8.2 | 3.9 | 3.7 |
| Wt. Loss of HSAB Product, % | | | | 64 |
| Estimated Wt Loss of Rawhide, % | | | | 55.8 |

What is claimed is:

1. An improved process for recovering hard acids and soft bases used to decompose coal in which finely divided coal particles are contacted with a hard acid in the presence of a soft base at temperatures of from 0° to 100° C., said hard acid being characterized by a heat of reaction with dimethylsulfide of from 10 kcal/mol to 30 kcal/mol and said soft base being characterized by a heat of reaction with boron trifluoride of from 10 kcal/mol to 17 kcal/mol, followed by extracting the decomposed coal to remove said hard acid and soft base wherein the improvement comprises performing said extraction at a temperature of about 0° to about 50° C. using dimethylcarbonate as the extraction solvent, and wherein following said dimethylcarbonate extraction, said coal is extracted with water at a temperature of from about 60° to 275° C., and wherein following said water extraction, said coal is soxhlet extracted in sulfolane at a temperature of about 25 to about 350° C., and wherein following said sulfolane extraction, said coal is soxhlet extracted to remove said sulfolane.

2. A process according to claim 1 wherein said hard acid is methanesulfonic acid, benzenesulfonic acid, toluenesulfonic acid and mixtures thereof.

3. A process according to claim 1 wherein said soft base is dimethylsulfide, diethylsulfide, methylphenylsulfide and mixtures thereof.

4. A process according to claim 1 wherein said hard acid is methanesulfonic acid and said soft base is dimethylsulfide.

5. A process according to claim 1 wherein said finely divided coal has a particle size of from 10 to 1000μ.

6. A process according to claim 1 wherein said coal is soxhlet extracted to remove sulfolane, said extraction is carried out using water, benzene, toluene, xylene, chlorobenzene, methanol and mixtures thereof.

7. A process for the hydroprocessing of coal to produce light hydrocarbon oils which comprises:

decomposing coal by contacting finely divided coal particles with a hard acid in the presence of a soft base at temperatures of from 0° to 100° C., said hard acid being characterized by a heat of reaction with dimethylsulfide of from 10 kcal/mol to 30 kcal/mol and said soft base being characterized by a heat of reaction with boron trifluoride of from 10 kcal/mol to 17 kcal/mol;

extracting the decomposed coal with dimethylcarbonate (DMC) at a temperature of about 0° to 50° C. to remove hard acid and soft base;

extracting said DMC extracted coal with water at a temperature of about 60° C. to about 275° C.;

soxhlet extracting said water extracted coal with sulfolane;

soxhlet extracting said sulfolane extracted coal to remove said sulfolane;

forming a mixture of decomposed coal and catalyst precursor containing a dihydrocarbyl substituted dithiocarbamate of a metal selected from any one of groups IV-B, V-A, VI-A, VII-A and VIII-A or mixtures thereof;

hydroprocessing the mixture at temperatures of from 250° C. to 550° C. and a hydrogen partial pressure of 2100 kPa to 35000 kPa; and recovering hydrocarbon oil.

* * * * *